United States Patent [19]

Piepenhagen et al.

[11] 4,043,384

[45] Aug. 23, 1977

[54] SPRAY APPARATUS FOR CONTINUOUS CASTING MACHINE

[75] Inventors: John H.K. Piepenhagen; Michael J. Vanecek, both of Beaumont, Tex.

[73] Assignee: Georgetown Texas Steel Corporation, Beaumont, Tex.

[21] Appl. No.: 731,615

[22] Filed: Oct. 13, 1976

[51] Int. Cl.[2] ..... B22D 11/12

[52] U.S. Cl. ..... 164/282; 118/316; 164/283 S

[58] Field of Search ..... 164/89, 282, 283 R, 164/283 S, 283 MS; 118/315, 316; 239/207, 266

[56] References Cited

U.S. PATENT DOCUMENTS

| | | | |
|---|---|---|---|
| 762,014 | 6/1904 | Wittbold | 239/207 X |
| 3,572,423 | 3/1971 | Bick et al. | 164/283 S |
| 3,931,848 | 1/1976 | Schmid | 164/283 R |

*Primary Examiner*—Robert D. Baldwin
*Attorney, Agent, or Firm*—Ralph H. Dougherty

[57] ABSTRACT

A spray apparatus for a continuous casting machine for delivering spray water to all faces of a partially solidified metal casting as it emerges from the bottom of a tubular mold, in which the spray apparatus includes a water source, a water distribution ring around the outside of the mold, and downwardly extending water pipes, each pipe carrying a nozzle at its lower extremity, which nozzle is directed toward a face of the hot casting as it emerges from the mold. The invention is characterized by the entire spray apparatus being protected by the walls of the mold from the effects of the heat and breakout of molten metal.

4 Claims, 4 Drawing Figures

SPRAY APPARATUS FOR CONTINUOUS CASTING MACHINE

BACKGROUND OF THE INVENTION

This invention relates to the continuous casting of metal such as steel, and more particularly to apparatus for spraying cooling water on all faces of a descending, at least partially solidified casting, on its emergence from a tubular flow-through mold.

SUMMARY OF THE INVENTION

The structure of our invention comprises cooling water piping attached to a mold, and detachable spray heads beneath the bottom of the mold directed toward the emerging solidifying casting. The spray heads form the lower terminus of the spray apparatus. The entire spray apparatus, with the sole exception of the spray heads, is protected from damage from heat and molten metal splash by its location adjacent the mold walls.

Heretofore, a spray ring for initially cooling a casting as it emerges from a water-cooled mold has been located at an elevation between the bottom of the mold and the foot rolls which are the first conducting rolls or pinch rolls beneath the mold. The entire width of each face of the casting must, of course, be contacted by cooling water spray to continue solidification of the casting.

In the continuous casting operation, molten metal is poured into the upper end of a tubular, vertically reciprocating mold to a predetermined level. The mold is closed at its lower end by a removable block called a chill plate which is connected to a starter bar. After initial solidification of the casting faces in the mold, the casting is moved downward under the control of pinch rolls, which engage first a starter bar and then the casting. The upper-most section of the casting emerging from the mold has only a thin solidified skin. Turbulent action of the molten metal within the casting, particularly when a solid inclusion is present, can remelt or rupture the skin causing what is termed a "breakout" whereby molten metal flows through an opening in the solidified skin, usually with catastrophic results, both damaging adjacent machinery and endangering human beings in the vicinity. When a breakout occurs, the most frequently damaged item is the spray ring beneath the mold jacket and above the foot rolls or pinch rolls. This spray ring includes a specially machined spray head for distributing spray water evenly across the face of the casting.

It is therefore the principal object of this invention to provide a spray apparatus for delivering spray water to all faces of a casting which is at least partially solidified, which apparatus is effectively protected from damage by heat and molten metal impingement.

We have developed a simplified spray ring for use with a continuous casting mold which minimizes the cost of replacement as well as caster downtime for replacement of the spray heads, or of any spray head damaged by contact with molten metal.

DETAILED DESCRIPTION

Figure 2:
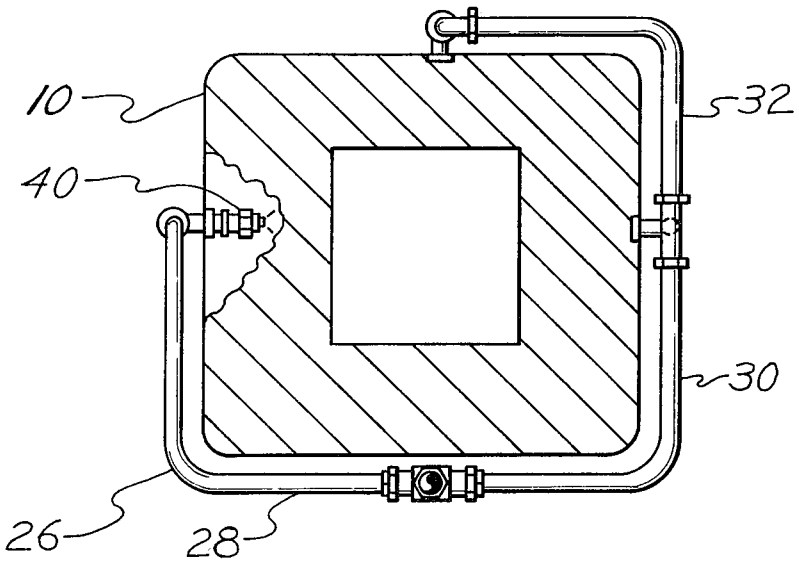
FIG. 2 is a top view of the spray ring of our invention.
Figure 1:
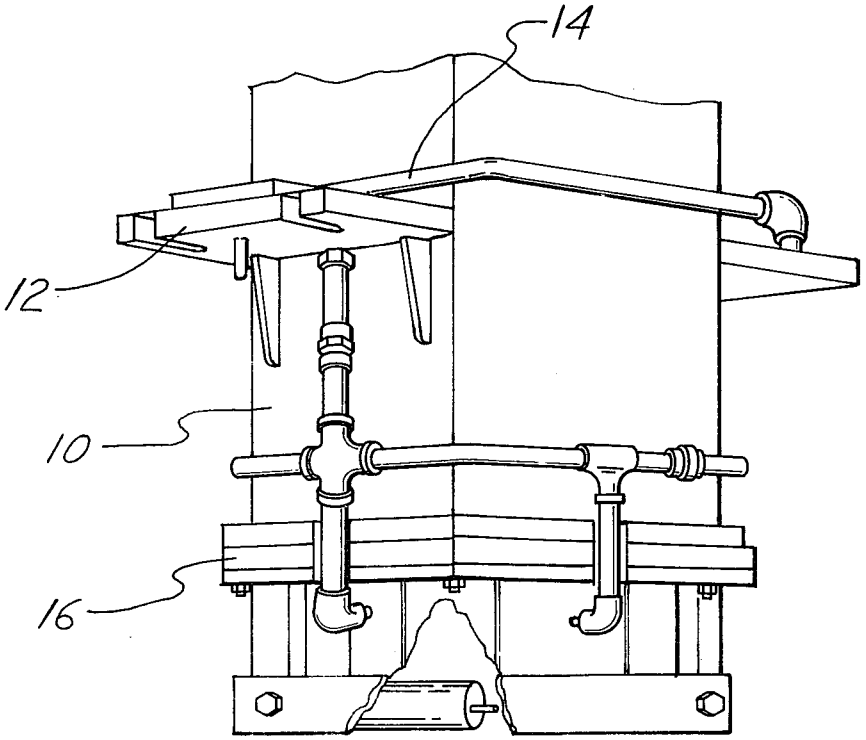
FIG. 1 is a partially cut-away isometric view of a tubular, flow-through mold utilizing the modified spray ring of our invention.
Figure 4:
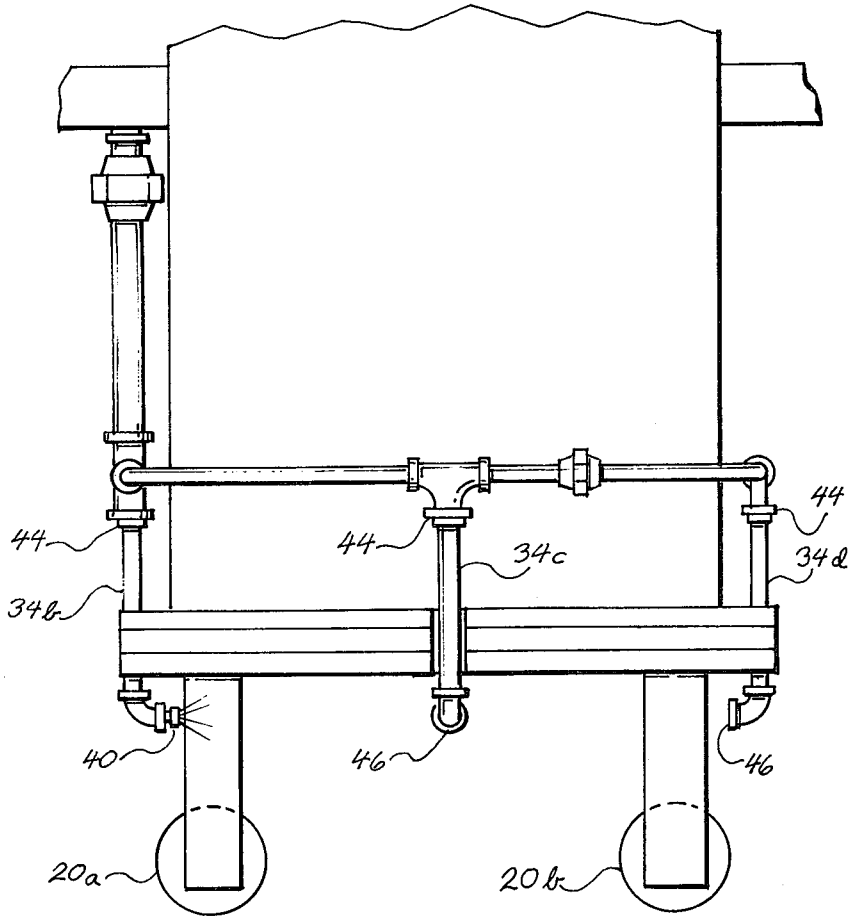
FIG. 4 is a right side view of the spray ring of our invention.
Figure 3:
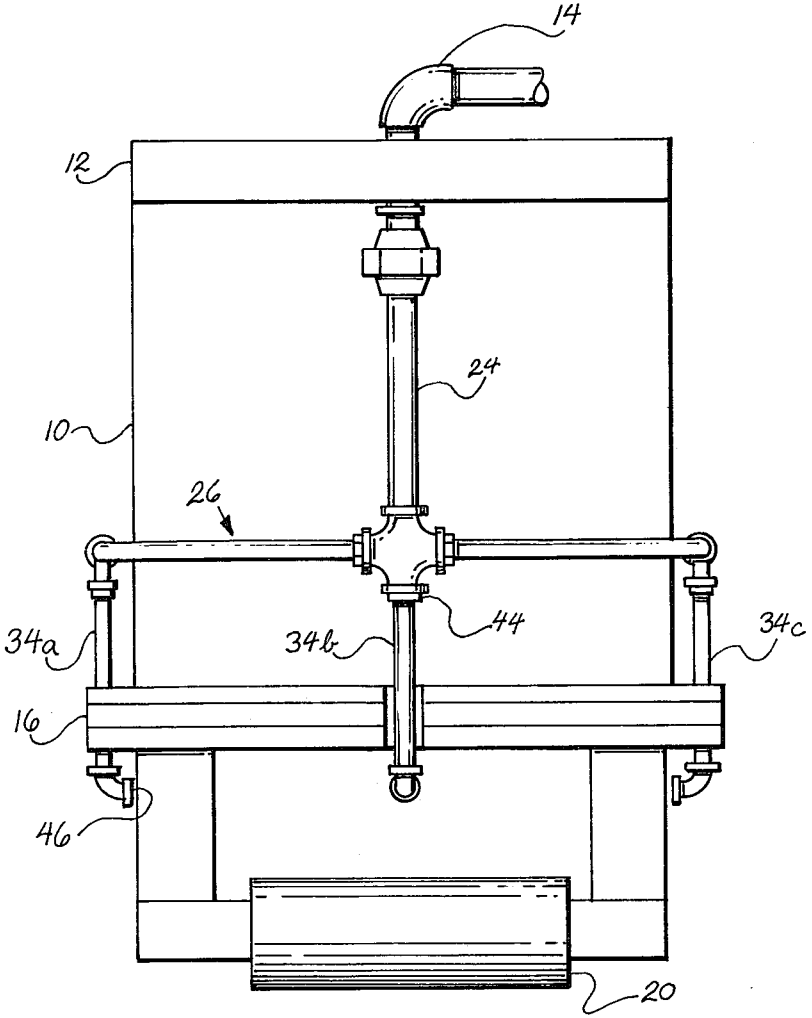
FIG. 3 is a front elevational view of the spray ring of our invention.

In the preferred embodiment of our invention, a vertically oscillatable mold 10 (FIG. 1) has a mold support plate 12 carrying a water distributor 14. A casting withdrawal unit fastened to the mold by mold flanges 16 includes a pair of foot rolls or pinch rolls 20*a* and 20*b.* Main water pipe 24 connects water distributing ring 26 to water distributor 14 through mold support plate 12 and depends downwardly therefrom. Water distribution ring 26 consisting of distributor pipe segments 28, 30 and 32, best seen in FIG. 2, extends generally horizontally around the mold 10 at an elevation above the bottom flange 16 of mold 10. From approximately the center of each mold face a distributor pipe 34*a,* 34*b,* 34*c,* 34*d,* extends downwardly and carries at its end an inwardly directed spray nozzle 40.

In case of a breakout, only the damaged spray nozzle need be replaced. All other portions of the spray ring water distribution system remain operable because all components are protected from heat and molten metal by their location on the mold walls. The spray nozzles, which are usually V-Jet nozzles that emit a flat stream of spray water, are readily replaceable items and are readily disconnectable from the spray apparatus either at distributor pipe connection 44 adjacent distributing ring 26, or at spray nozzle connection 46, at which point spray nozzle 40 is attached to distributor pipe 34. The pipe and nozzle attachments may be by threaded connectors or any other suitable type of fitting or disconnectable mounting.

It should be clear that the invented spray ring is adaptable to slab casters by merely increasing the number of downwardly extending distributor pipes 34 and nozzles 40 to that required to contact the entire perimeter of a cross-section of the casting.

By installing the invented apparatus on a continuous caster, we have effected a 98 percent savings in the cost of required replacement items in the spray apparatus when a catastrophic breakout occurs. Additionally, fewer man-hours of labor are required to replace spray heads when using our invention than with prior spray rings.

From the foregoing, it is readily apparent that our invention provides a mold spray quench system for causing quenching spray to impinge upon each face of a continuously cast metal casting as it emerges from the mold, yet all of its components other than the spray nozzles are protected from damage caused by breakout.

We claim:

1. In a continuous casting machine which includes a tubular mold, a support for said mold and roller means beneath said mold for withdrawing a casting therefrom, the combination therewith of an improved mechanism for delivering spray water to all faces of a casting as it emerges from the bottom of said mold, said mechanism comprising: a water source communicating with said mold support, a first water distribution pipe depending from said mold support, a second water distribution pipe connected to said first pipe and extending generally in a horizontal plane and reaching each face of said mold, a multiplicity of downwardly extending water pipes communicating with said second distribution pipe, each downwardly extending pipe terminating beneath said mold and carrying a nozzle at its lower extremity, said nozzles being directed inwardly toward said mold whereby spray water delivered through said nozzles will contact the entire perimeter of a casting during withdrawal from said mold, and the entire spray mechanism with the exception of the nozzles is insulated from the casting by the vertical walls of the mold.

2. A combination according to claim 1 in which said nozzles are positioned as horizontally opposed pairs.

3. A combination according to claim 1 wherein said nozzles are removably connected to said downwardly extending pipes.

4. A combination according to claim 1 wherein said downwardly extending pipes are removably connected to said second water distribution pipes.

* * * * *